US007909190B2

(12) United States Patent
Schäfer

(10) Patent No.: US 7,909,190 B2
(45) Date of Patent: Mar. 22, 2011

(54) STORAGE, TRANSPORTING, STACKING AND ORDER-PICKING CONTAINER

(75) Inventor: Gerhard Schäfer, Neunkirchen (DE)

(73) Assignee: Fritz-Schafer GmbH, Neunkirchen (DE)

( * ) Notice: Subject to any disclaimer, the term of this patent is extended or adjusted under 35 U.S.C. 154(b) by 481 days.

(21) Appl. No.: 12/093,837

(22) PCT Filed: May 16, 2006

(86) PCT No.: PCT/EP2006/004582

§ 371 (c)(1),
(2), (4) Date: May 15, 2008

(87) PCT Pub. No.: WO2007/062695

PCT Pub. Date: Jun. 7, 2007

(65) Prior Publication Data

US 2008/0283536 A1 Nov. 20, 2008

(30) Foreign Application Priority Data

Nov. 30, 2005 (DE) ..... 20 2005 018 815 U
Dec. 23, 2005 (DE) ..... 20 2005 020 276 U

(51) Int. Cl.
*B65D 1/34* (2006.01)

(52) U.S. Cl. ..... 220/7; 220/6; 220/558

(58) Field of Classification Search ..... 220/4.28, 220/6, 7, 558
See application file for complete search history.

(56) References Cited

U.S. PATENT DOCUMENTS 3,840,115 A * 10/1974 Ladewig ..... 206/506
5,238,115 A * 8/1993 Schafer ..... 206/503
5,503,294 A * 4/1996 Taylor et al. ..... 220/571
5,632,392 A * 5/1997 Oh ..... 220/7
6,290,081 B1 * 9/2001 Merey ..... 220/7
6,843,386 B2 * 1/2005 Raghunathan et al. ..... 220/7

FOREIGN PATENT DOCUMENTS

EP 0876963 11/1968

* cited by examiner

*Primary Examiner* — Stephen Castellano
(74) *Attorney, Agent, or Firm* — Alfred Wilford

(57) ABSTRACT

For a storage, transport, stacking, and order-picking box (1) having a floor (2) and four walls (3*a* and 3*b;* 4*a* and 4*b*), of which at least one wall (4*b*) is designed as a movable element and in such a way that it can be latched to the adjacent walls (3*a* and 3*b*), wherein after being unlatched the one wall (4*b*) can be moved away to open up a large unloading opening (18) into the box interior, the movable box wall (4*b*) on at least one of its two outer edges has latching and unlatching means (9; 119) that are integrated into the wall structure, are freely accessible from the front, can be pivoted in a vertical plane in the clockwise and counterclockwise directions, and can be latched to the respective associated adjacent wall (3*a* and 3*b*).

15 Claims, 11 Drawing Sheets

STORAGE, TRANSPORTING, STACKING AND ORDER-PICKING CONTAINER

CROSS REFERENCE TO RELATED APPLICATIONS

This application is the US national phase of PCT application PCT/EP2006/004582, filed 16 May 2006, published 7 Jun. 2007 as WO 2007/062695, and claiming the priority of German patent application 202005018815.8 itself filed 30 Nov. 2005 and PCT patent application PCT/EP2006/004582 itself filed 16 May 2006, whose entire disclosures are herewith incorporated by reference.

FIELD OF THE INVENTION

The invention relates to a stackable storage, transport, and order-picking box having a floor and four upright walls at least one of which is designed as a movable element in such a way that it can be latched to the adjacent walls and that after being unlatched can be moved out to create a large access opening into the box interior.

BACKGROUND OF THE INVENTION

For storing large objects, stackable transport boxes having correspondingly large dimensions are provided in the prior art, having a flap which can be rotated in the side walls about a horizontal axis to allow loading and unloading of objects. The rotatable flap is rotatably connected to an insertion piece which is fastened in a corresponding recess in the side wall. Such a box is known from EP 876 963.

However, for these boxes it is not possible to load and unload objects, in particular large-surface objects; i.e. the boxes must be removed from the shelves and the objects must be removed from the top. This is very laborious, time-consuming, and cost-intensive. In addition, these boxes are not suitable for high shelves or roller conveyors, in particular because of their high-volume, preferably rectangular dimensions. Furthermore, the known boxes are provided with straight vertical walls and therefore cannot be transported as space-economizing empty boxes. Tapered rotary stacking boxes are recommended for this purpose.

However, it is generally known that boxes that are nestable or partially nestable, i.e. stackable inside one another, or stackable one on top of the other with cross-bracing according to the rotary stacking principle, can be nested together only to the extent that this is applicable to internally stackable tapered boxes, such that an inclination of the side wall provides a clearance of the actual wall thickness of this side wall with respect to the vertical during nesting, since otherwise a clamping effect would result.

However, the taper of the side walls does not allow large-dimension profiles or wall thicknesses, and therefore the box walls are not strong enough. This is a serious drawback, in particular for heavy objects and correspondingly high loads. The criss-cross stacking principle, with crossing surfaces, results in a beamlike or flanged profile which achieves sufficient rigidity to prevent buckling of the walls under compression pressure or load. However, to obtain a maximum loading and emptying, opening this static structure is largely impossible, and cannot withstand the demands under load.

The boxes, among other requirements, must also be able to hold large volumes of objects (for example, cable spools, electrical conduits, etc.). In addition, it must be possible to store the boxes and the objects therein in high shelves, and after a requisition synchronized with production, to remove the boxes.

After removal, it must be possible to transfer the boxes into transport carts or open shelves directly at the production facility or installation site for the objects, for example manually or by use of handling equipment that pulls up to the transport cart or shelf and pulls the objects onto a transport pallet or the like. In addition, for empty transport the greatest possible reduction in volume is sought, which is made possible in particular by the shape of the tapered boxes.

To eliminate these disadvantages and provide a storage, transport, stacking, and order-picking box having minimal volume and high load capacity, and in particular also having a closable unloading opening of maximum size without interfering edges, a box of the type mentioned at the outset and according to a prior patent application by the applicant is proposed. This design allows a composite wall, in which for a rectangular box preferably at least one of the end walls is movable, for example by means of a hinged bottom, or removable as a whole so that after the movable box wall is folded away or removed a large or completely accessible opening into the box interior is created. At the same time, by use of stacking pressure-transmitting and nesting shapes (corner recesses, depressions, or the like) the box is also suitable for superposed stacking according to the crosswise and transverse stacking principle. After latching to the side walls, the compact, stable composite wall is able to withstand a very large stacking pressure, regardless of whether the box has tapered or vertical walls. It is thus possible to stack multiple boxes atop one another for transport, or to compactly nest the boxes for empty or return transport by virtue of the taper, i.e. the stacking edge of the boxes. For latching or unlatching, however, in this case a bar that is accessible from above must be raised or lowered and pivoted out laterally, or for latching, pivoted in from the outside, about pins.

OBJECT OF THE INVENTION

The object of the invention is to improve a generic box, while retaining all the other advantages, in such a way that the box allows safely operable, user-friendly, and simple latching and unlatching of the movable box wall.

SUMMARY OF THE INVENTION

This object is achieved according to the invention by the fact that the movable box wall on at least one of its two outer edges has latching and unlatching means that are integrated into the wall structure, are freely accessible from the front, can be pivoted in a vertical plane in the clockwise and counterclockwise directions, and can be latched to the respective associated adjacent wall. The latching and unlatching means, preferably provided in the two upper corner regions of the box wall, on the one hand are thus protected from the outside and accommodated without projecting on the sides. On the other hand, for actuation the latching and unlatching means are still freely accessible from the front, and for adjacent boxes may be individually latched or unlatched. This is achieved completely without interference, since the closing or opening motion extends in the vertical plane of the box walls without the need for lateral clearance, so that the latching and unlatching means do not project beyond the envelope, i.e. the top surface, of the box.

In one embodiment of the invention, the latching and unlatching means are provided beneath a skirt for the movable box wall and are designed as an elongated, spring-loaded latching lever that is pivotable about a horizontal pivot axis and whose rear lever end together with a latch head projects from a corner section of the skirt that is recessed at the top and snaps into a top frame of the adjacent wall.

According to one preferred embodiment of the invention, a left-side and a right-side latching lever are connected to one another in a motion-dependent manner via a common pivot element. This allows the latching levers on each side to be simultaneously and synchronously actuated, and permits the end wall to be latched and unlatched by one hand.

In one advantageous design, the pivot element is composed of a central round-section part and force-transmitting profiles projecting therefrom to the left and right of the latching levers. The round-section part, which preferably may be provided with a one-hand actuating element that is thus centrally situated, preferably a molded-on handle or alternatively a bracket or the like, ensures proper rotational motion. The force-transmitting profiles reinforce the pivot unit (including the pivot element with the latching levers), and provide considerable robustness.

Actuation of the central handle, bracket, or the like causes the latching levers to move against a spring force into the unlatched position, the spring means being constituted in the form of compression springs or tension springs above or below the latching levers.

In all of these designs the latching mechanism as a whole is enclosed in the cavity formed by the skirt or skirt-like upper edge of the box, and is completely protected from the outside. Only the one-hand actuating element (molded handle, bracket) or the handle that according to one design of the invention is advantageously provided at the front end of the latching lever and projects from the skirt in a curved downward fashion in the a opposite the latch heads. In the latched position neither the one-hand actuating element nor the handle projects forward from the envelope or shape of the box.

According to one proposal of the invention, the latch heads are each provided with a actuation face that slopes down obliquely and to the rear facing the adjacent wall. When the box wall is inserted or pivoted for closing the unloading opening, the latch head automatically slides down upon striking the oppositely situated end face of the adjacent wall, and the latching lever pivots against the force of the spring until the latch head has passed its stop surface, and then with a pivot motion of the latching lever in the opposite direction snaps into the latched position behind the stop surface.

It is advantageous to provide the end face of the movable box wall facing the adjacent wall with a vertical cutout, and to provide the opposite end face of the adjacent wall with a projection that in the latched state fits in the cutout. The additional tongue-in-groove connection thus achieved for the latch head of the latch, where the projection represents the tongue that may even pass through the cutout, makes the latch even more secure. Even for boxes stacked one on top of the other under very heavy load, which could result in deformation of the lower box(s), the latch does not come disadvantageously undone automatically.

The latching lever may advantageously be manufactured in one piece with a flexible spring that in the installed position is supported at the underside of the top edge of the movable box wall. The latching lever together with the flexible spring may be easily manufactured by injection molding of plastic.

The primary contribution of the instant invention is that form-fit, stable interconnected stacking may be achieved in space-economizing empty transport of tapered boxes stacked one inside the other by means of outer lugs for the stacked upper box that may be engage in seats of the respective lower box.

The box wall or end wall is preferably opened completely to allow heavy, large-volume objects to be stored or removed without lifting. The box wall or end wall may advantageously be movably connected to the box in the floor region by means of a pivot element, a hinge that for additional stabilization may optionally be provided with a socket pin, or the like. Alternatively, the end wall may be designed so as to be completely removable, i.e. detachable from the contiguous side walls.

In the opened state of the box side as the result of flap-like pivoting or removal of the end wall, a maximized order-picking or removal opening may be obtained from which the objects may be easily loaded or unloaded without limiting, interfering shapes, in particular for large-volume objects, when the end wall is completely opened or removed.

Handle pockets and/or grips for manual transport are preferably built in. Seats for identification tags and for transponders can be read from a considerable distance, even in high shelves.

Upon closing, the advantageous shaped teeth on the respective sides or end faces of the box walls smoothly engage with one another in a form fit in the manner of a zipper, and support secure interconnection even when boxes holding heavy objects are stacked one on top of the other.

In the completely opened state, the box or end wall that is securely anchored to the box by means of the pivot element, hinge, or the like introduced in the floor region, remains at least horizontal at the front or is pivoted by more than 90° (see FIG. 6), or may be completely removed when it has a detachable design so as to be latchable only to the adjacent box walls or the like. In any case, the objects may be easily removed or stored.

BRIEF DESCRIPTION OF THE DRAWING

Further features and particulars of the invention are seen in the claims and the following description of the embodiments shown in the drawings. Therein:

SPECIFIC DESCRIPTION

Figure 1:
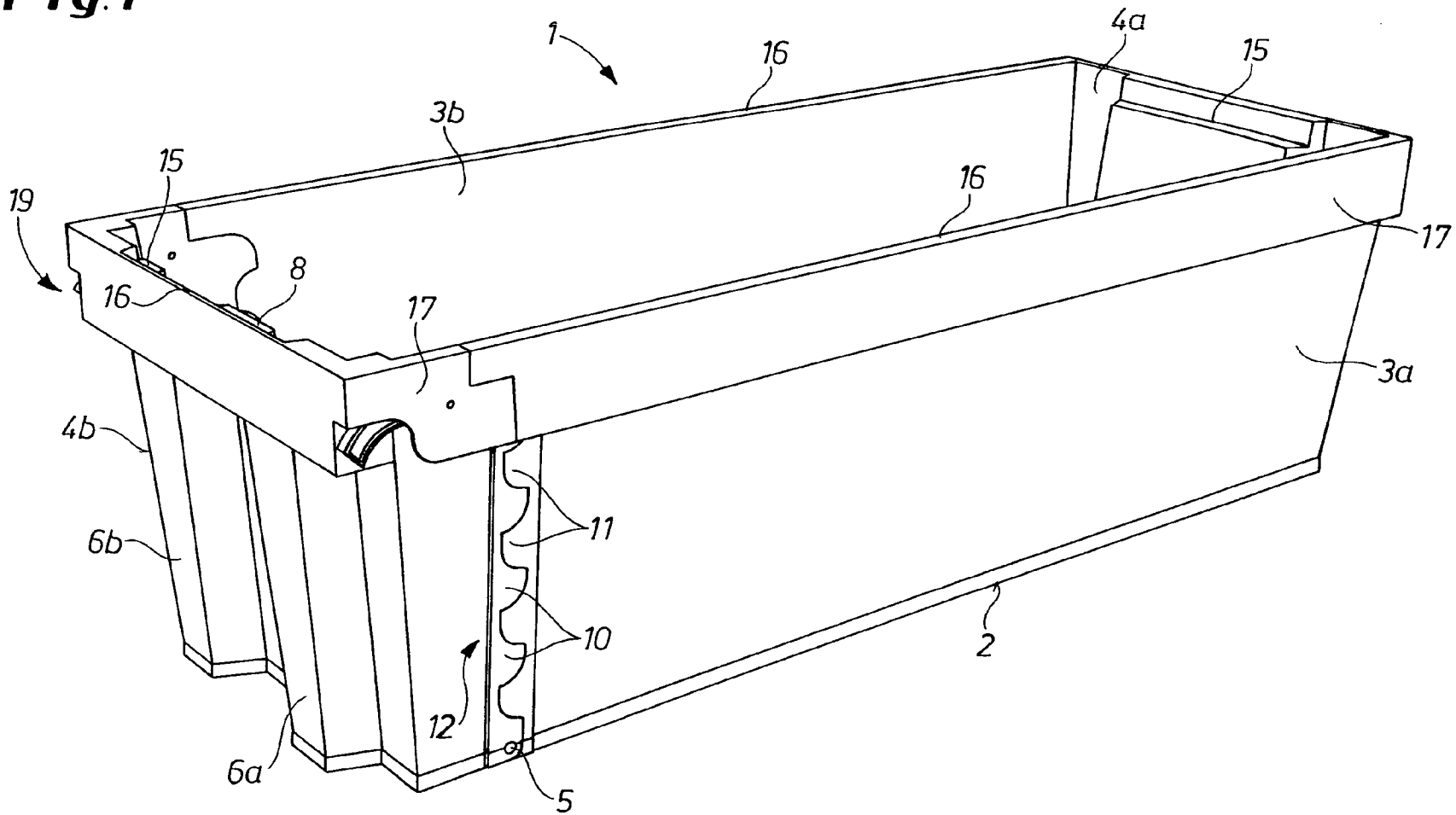
FIG. 1 shows a perspective overall top view of a box that in the illustrated embodiment is rectangular and closed, i.e. with the removal or order-picking opening in the end wall be closed and latched.
Figure 7:
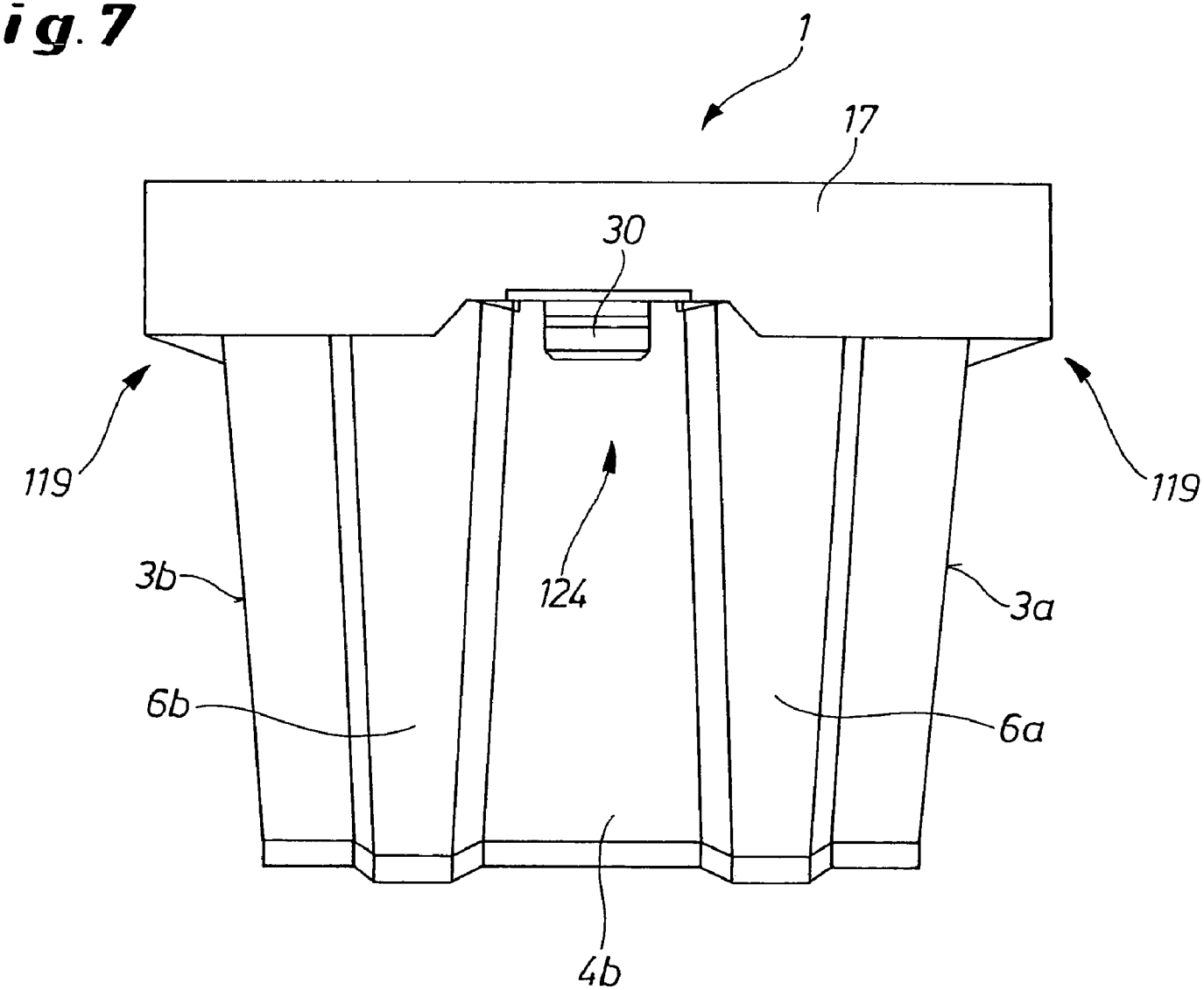
FIG. 7 shows a front view of the closed end wall of a box provided with a one-hand latching mechanism.
Figure 8:
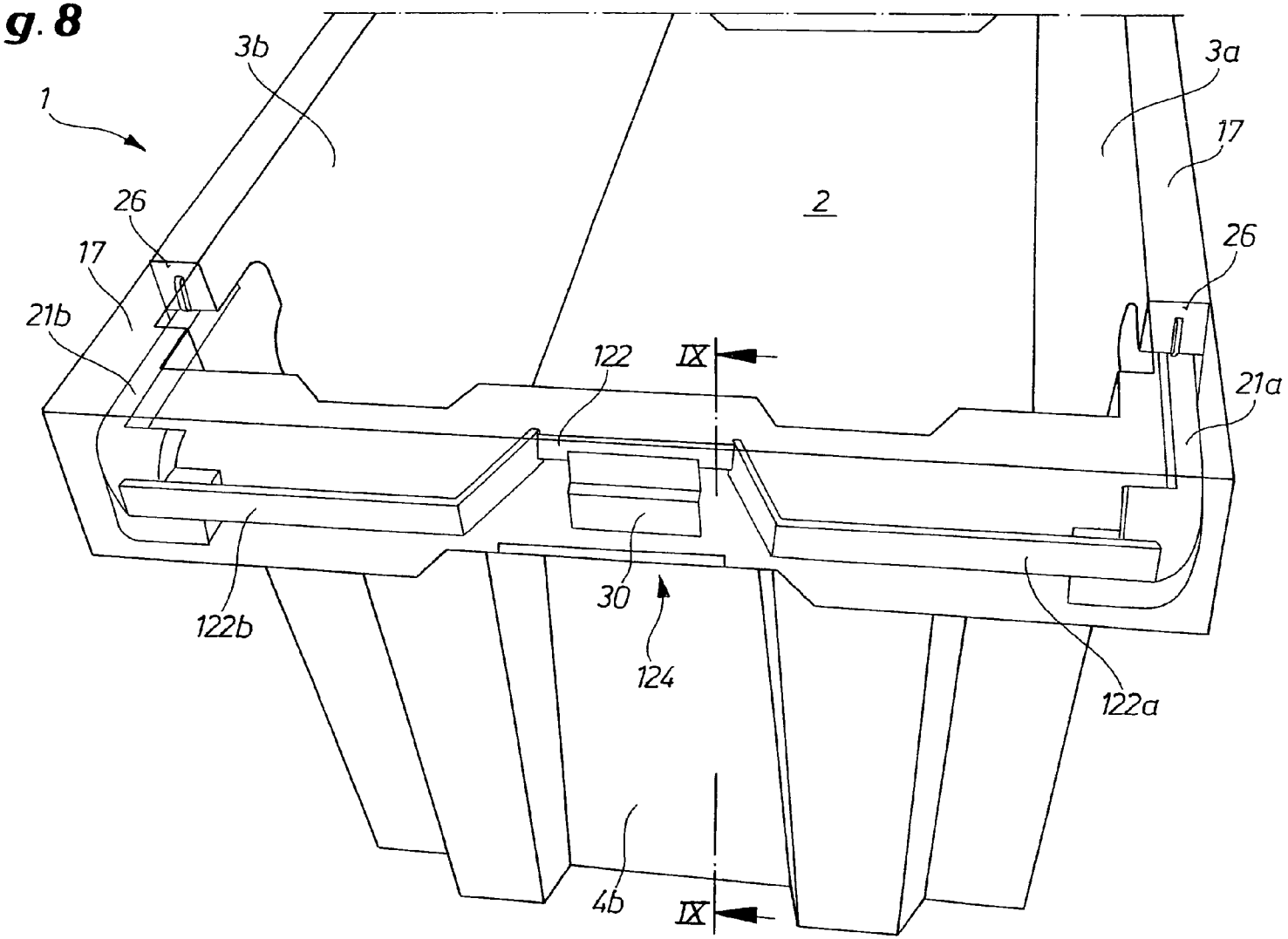
FIG. 8 shows a perspective partially cutaway top view of the box according to FIG. 7.

A rectangular and tapered box 1 shown in FIG. 1 and FIGS. 7 and 8 has a floor 2 with four upright walls, specifically, the two long side walls 3*a* and 3*b* and the two short end walls 4*a* and 4*b*, the left end wall 4*b* being designed to pivot about an axis 5 at the floor 2. Alternatively, this wall element as a whole could be detachably latched to the contiguous or adjacent side walls 3*a* and 3*b*, in which case it could be removed from the box 1.

Figure 4:
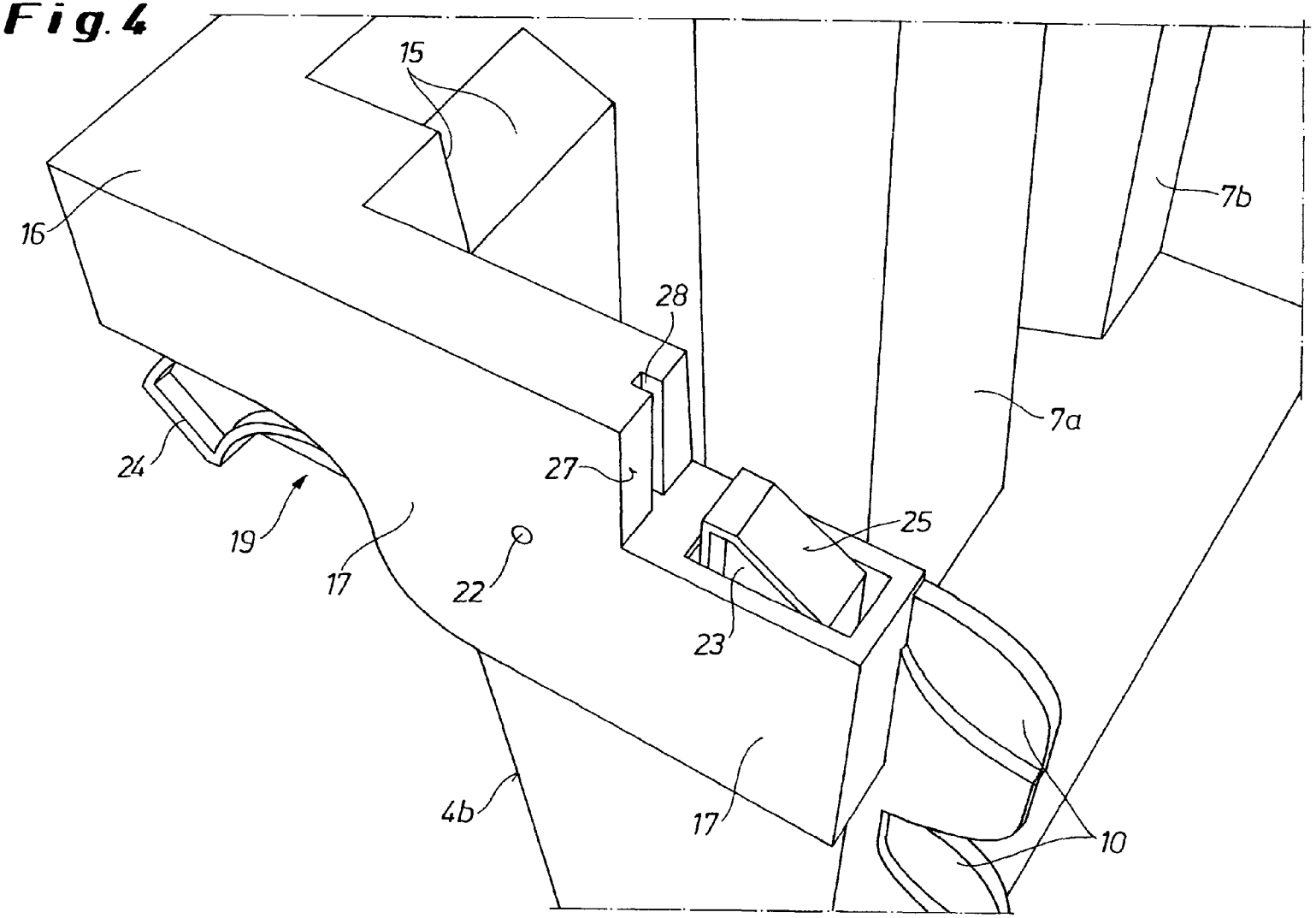
FIG. 4 shows a detail of a perspective partial view of the end wall together with the latch integrated therein.
Figure 5:
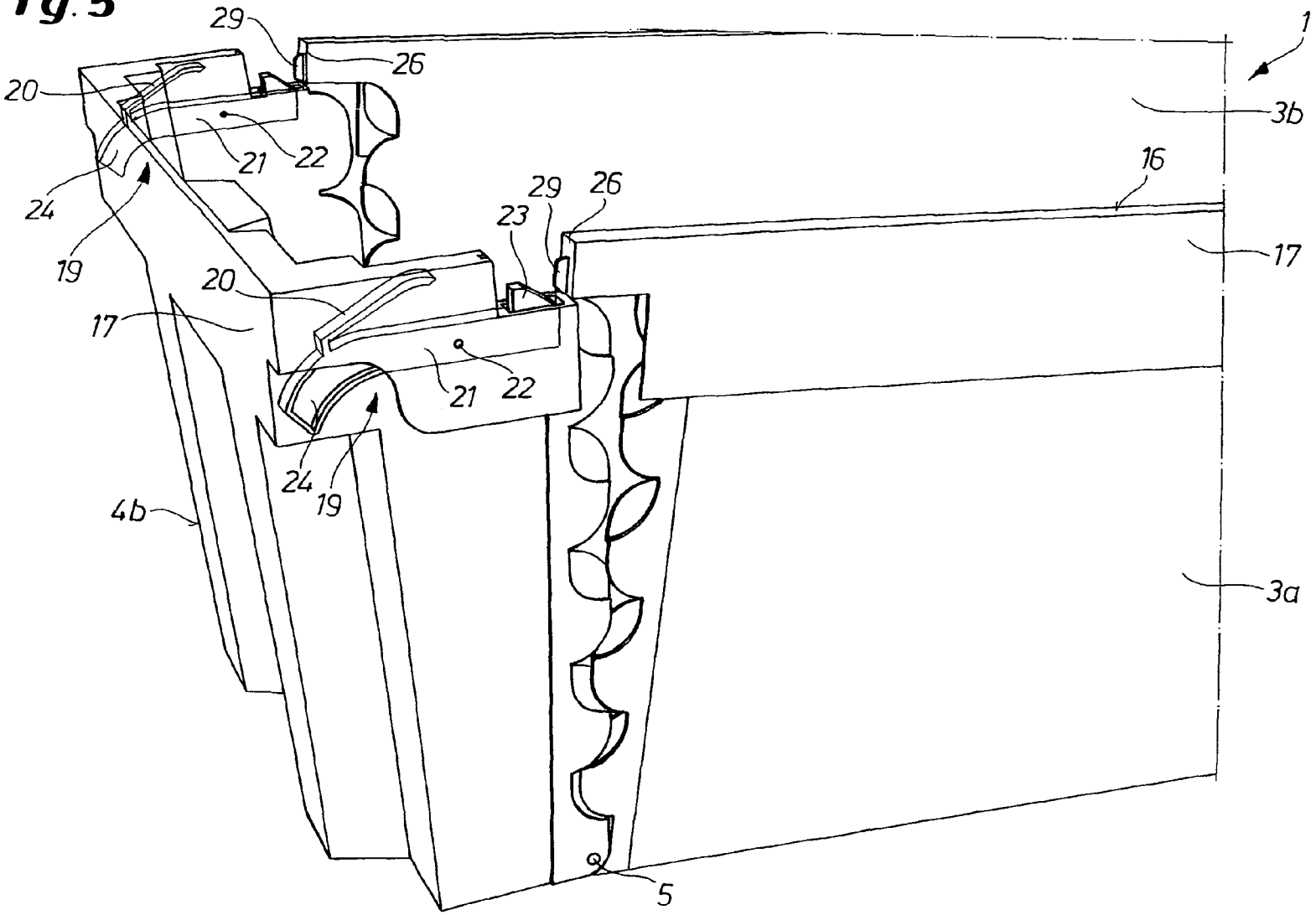
FIG. 5 shows a perspective partial view of the box with the end wall unlatched and partially open.
Figure 6:
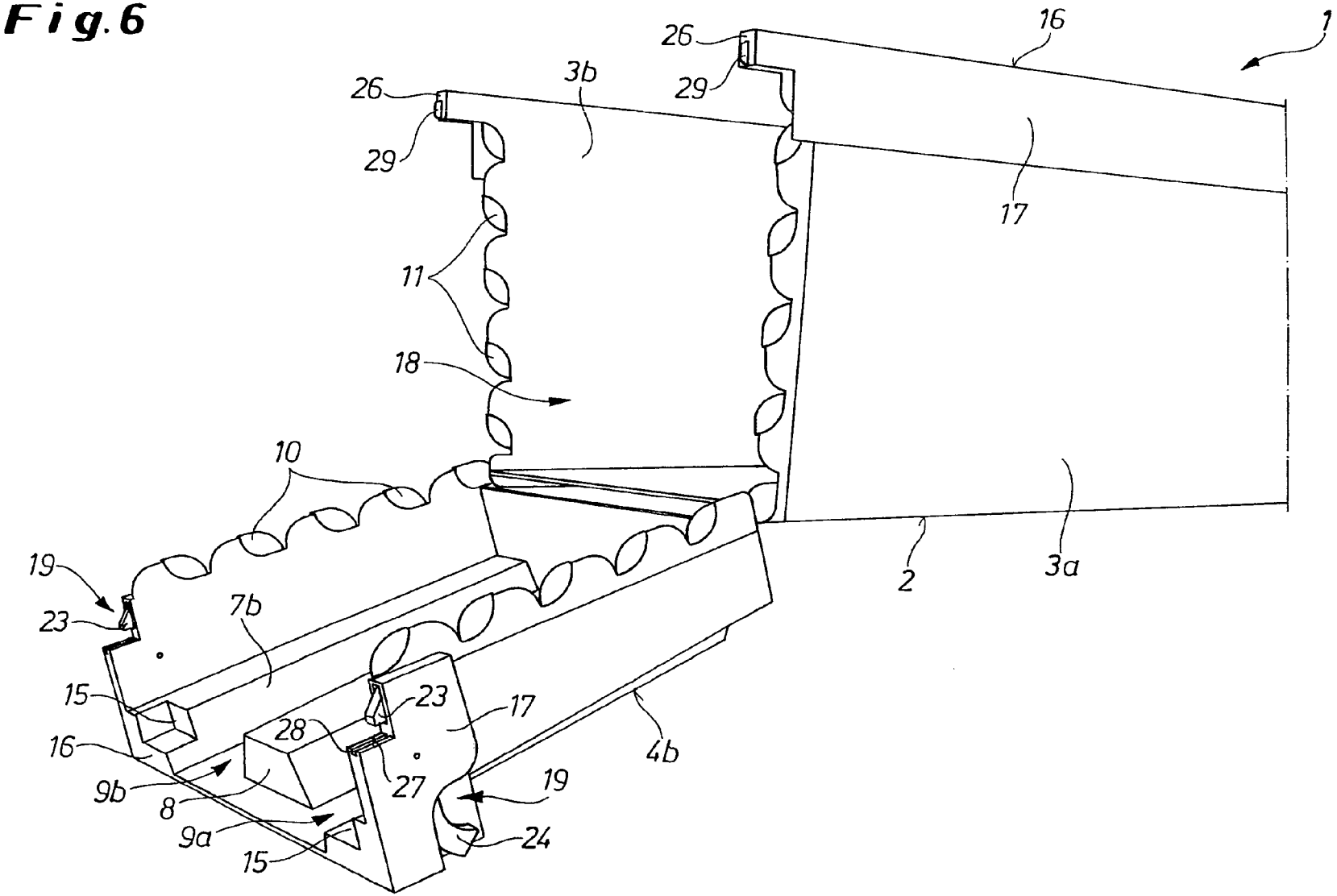
FIG. 6 shows a perspective partial view of the box with the end wall completely open.

The end wall 4*b* is designed as a stable composite wall that on its outer face has block-like outer wall ridges 6*a* and 6*b* that taper from top to bottom and are designed as outer face piece profiles, and that on its interior side has inner ridges 7*a* and 7*b* (see FIG. 4) designed as inner side profiles, and having a central block 8 that is set at a spacing from the inner ridges 7*a* and 7*b* by means of tapered insertion channels 9*a* and 9*b* having a shape complementary to the outer wall ridges 6*a* and 6*b* (see FIG. 6), and having resistant latch formations engaging the side walls 3*a* and 3*b*. When the empty boxes 1 are stacked one inside the other, the outer wall ridges 6*a* and 6*b* are sunk into the insertion channels 9*a* and 9*b* between the central block 8 and the inner ridges 7*a* and 7*b*.

Figure 9:
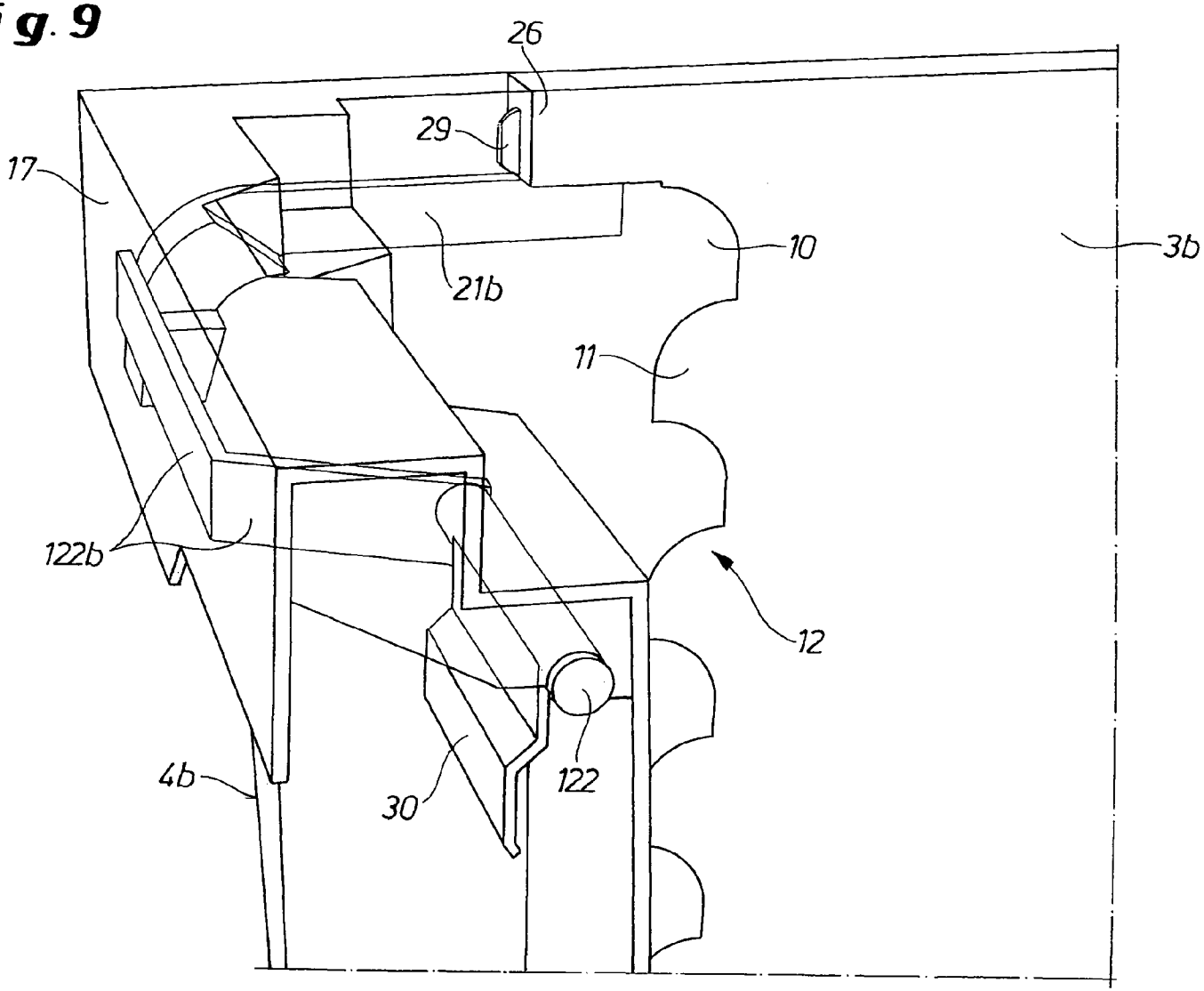
FIG. 9 shows a perspective illustration of a section along line IX-IX of FIG. 8.

When the box 1 is closed on the end face side (see FIGS. 1 through 3 and FIGS. 7 through 9), the end wall 4*b* is fixed in its upright position in a form-fit manner via lock formations 10 provided at its side edges, and on the opposite side via lock formations 11 (see FIGS. 6 and 9) provided on the end face edges of the side walls 3*a* and 3*b* by a type of toothed engagement 12 composed of small teeth having a crescent-like or curved shape and engaging with one another like a zipper.

To enable better resist of the large supporting forces when loaded, heavy boxes 1 are stacked one on top of the other, multiple stacking pressure-transmitting and nesting shapes 15 are provided at the upper edge 16 that is reinforced by a skirt 17 that simultaneously forms a handle or underside grip and extends along the side walls 3*a* and 3*b* flush with the skirt 17, and are also provided at the pivotable or removable end wall 4*b* as well as at the oppositely situated end wall 4*a* in the form of indentations. In the illustrated embodiment, these stacking pressure-transmitting and nesting shapes are provided at the pivotable end wall 4*b* at the heads of the inner ridges 7*a* and 7*b*, and merging into a continuous upper ridge of the top edge 16 having built-in partial shapes of the stacking pressure-transmitting and nesting shapes 15. The stacking pressure-transmitting and nesting shapes 15 also provide a secure positioning surface and support when empty boxes are stacked one inside the other.

In addition to the toothed engagement 12 for latching with the side walls 3*a* and 3*b* when the large order-picking or unloading opening 18 (see FIG. 6) obtained by pivoting away, folding up, or removing the end wall 4*b* is again closed, the movable box wall or end wall 4*b* has latching and unlatching means 19 or 119 (see FIGS. 5 and 6 or FIGS. 7 and 8) at its outer corner regions, integrated into and enclosed in the recess formed by the skirt 17 and that in the illustrated embodiment are located on both outer faces of the end wall 4*b*.

The latching and unlatching means 19 in the box design according to FIGS. 1 through 6 are each composed of a latching lever 21 manufactured in one piece with a flexible spring 20. This latching lever may be pivoted in the vertical plane in the clockwise direction about a horizontal pivot axis 22 of the end wall 4*b* for unlatching, and pivoted in the counterclockwise direction for latching. The rear end of the lever is provided with a latch head 23, and the front end of the lever is provided with a downwardly curved handle 24 that projects downward from the skirt 17.

The latch head 23 is provided with an actuation face 25 that slopes down obliquely and to the rear facing the adjacent wall, i.e. the side wall 3*a* and 3*b*, and that assists in pivoting the latching lever 21 downward against the force of the flexible spring 20 when the latching lever strikes a stop surface provided by a projecting end 26 (see FIGS. 5 and 6) of the apron 17 of the side walls 3*a* and 3*b*. The projecting end 26 has a complementary design with respect to a notch or recess in the skirt 17 for the end wall 4*b* into which the latch head 23 projects, and in the closed position fills the notch/recess. As soon as the latch head 23 has passed the stop surface, it automatically snaps into the cavity of the projecting end 26 of the skirt 17 for the side walls 3*a* and 3*b*, and the end wall 4*b* is latched (see FIG. 2).

Figure 2:
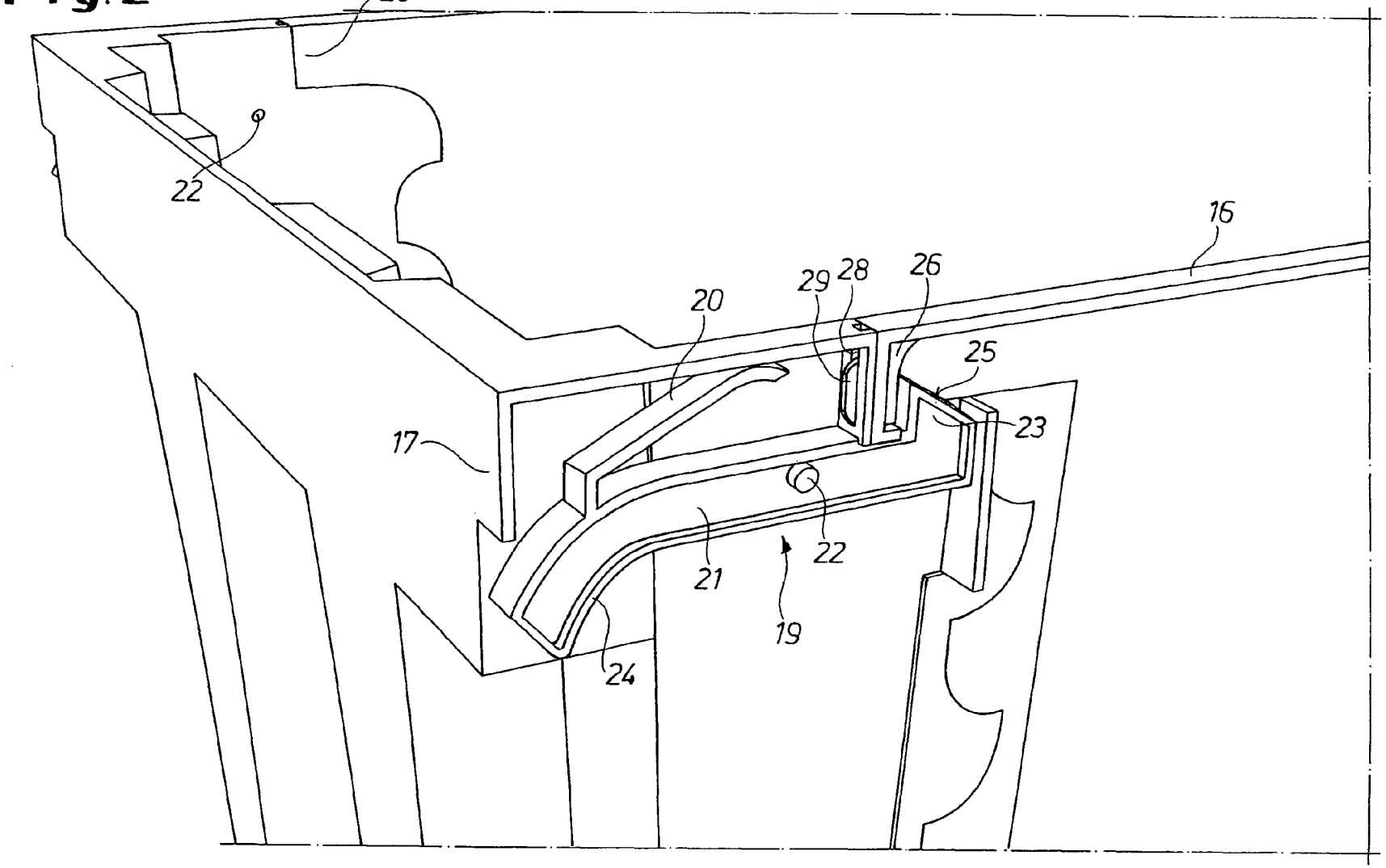
FIG. 2 shows a perspective partial view of the box according to FIG. 1 on the closed, partially cutaway end wall in the region of an outer laterally positioned latch.
Figure 3:
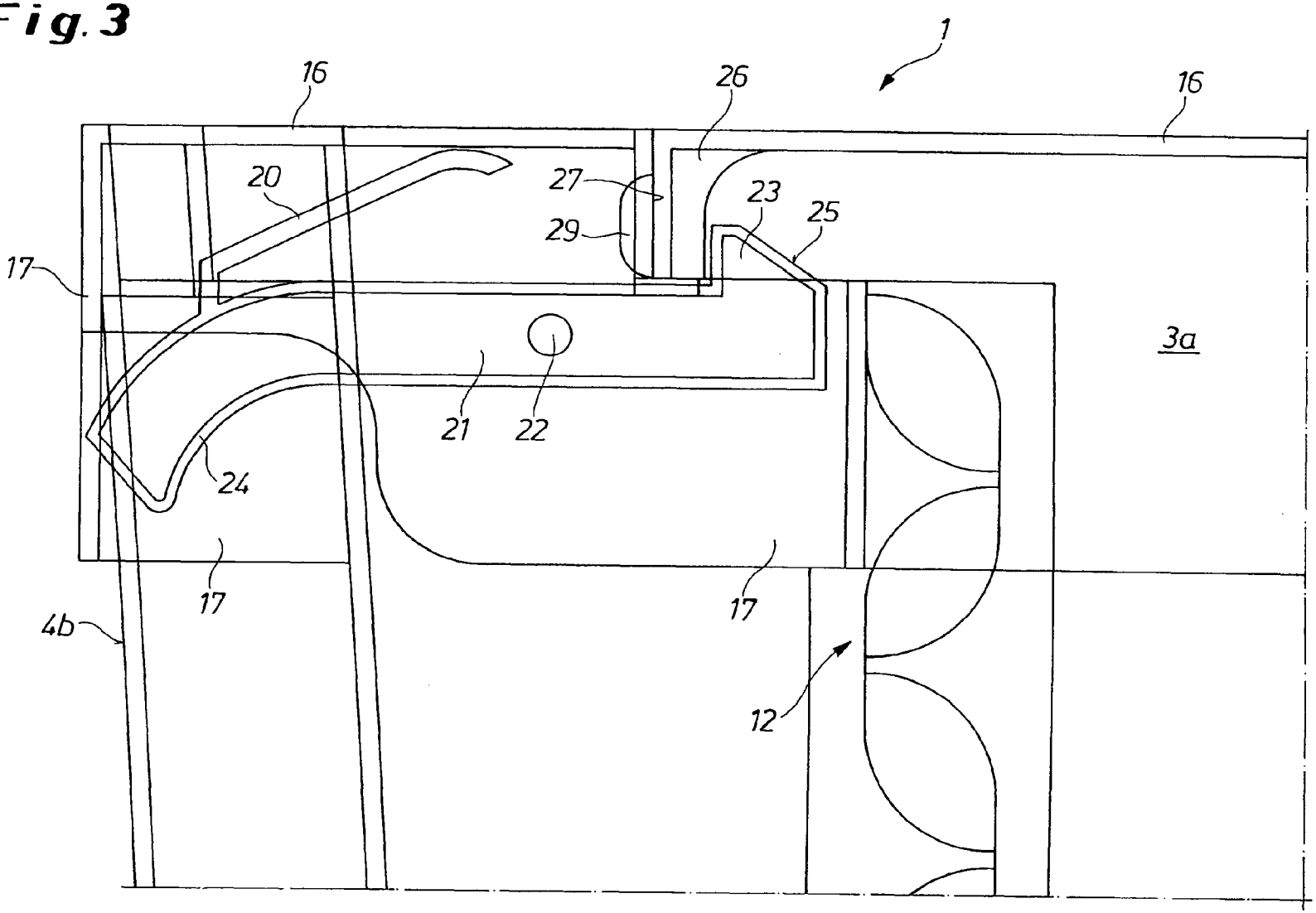
FIG. 3 shows a detail from FIG. 2 in a schematic side view.

The security and stability of the latched or closed position is enhanced by the fact that the end face 27 that faces the side walls 3*a* and 3*b* and which is provided by the notch/recess in the skirt 17 for the movable end wall 4*b*, is provided with a cutout 28 through which a projection 29 passes at the free end face edge of the projecting end 26 of the skirt 17, as shown in FIGS. 2 and 3.

When a large unloading opening 18 is required for the box 1, the handle 24 need only be gripped and pulled upward. The latching levers 21, i.e. the latch heads 23 thereof, thus snap downward and are released from their latching seats or engagement. The end wall 4*b* may thus be removed, folded down, or completely taken off, as illustrated in an intermediate stage in FIG. 5, until the entire removal/order-picking opening 18 (see FIG. 6) is freed. The closing and latching are performed in the opposite order and automatic pivot movement of the latching lever 21, first down, then up.

The design of the box 1 illustrated in FIGS. 7 through 11 differs from the previously described box only with to the type of latching mechanism, and therefore the same reference numerals are used even if they are not mentioned below. In the present case the movable end wall 4*b* is provided with a one-hand actuating element 124 (see FIGS. 7 and 8).

The one-hand actuating element 124 comprises a pivot element 122 that extends over the entire width of the end wall 4*b* and that is provided in its center with a round-section part and a molded handle 30 thereon that is thus centrally positioned. Extending to the left and right of the round-section part are force-transmitting profiles 122*a* and 122*b* by means of which the pivot element 122 is connected in a rotationally fixed manner to latching levers 21*a* and 21*b*. Apart from the separate handles and the flexible spring integrally molded on in one piece in the design according to FIGS. 1 through 6, the latching levers 21*a* and 21*b* essentially correspond to the latching levers 21 in these figures. In the present case, instead of the flexible spring integrally molded on in one piece, a compression spring 120 (see FIGS. 10 and 11) is braced below the latching levers 21*a* and 21*b*. Alternately, a tension spring on top could be used as a spring means.

Figure 10:
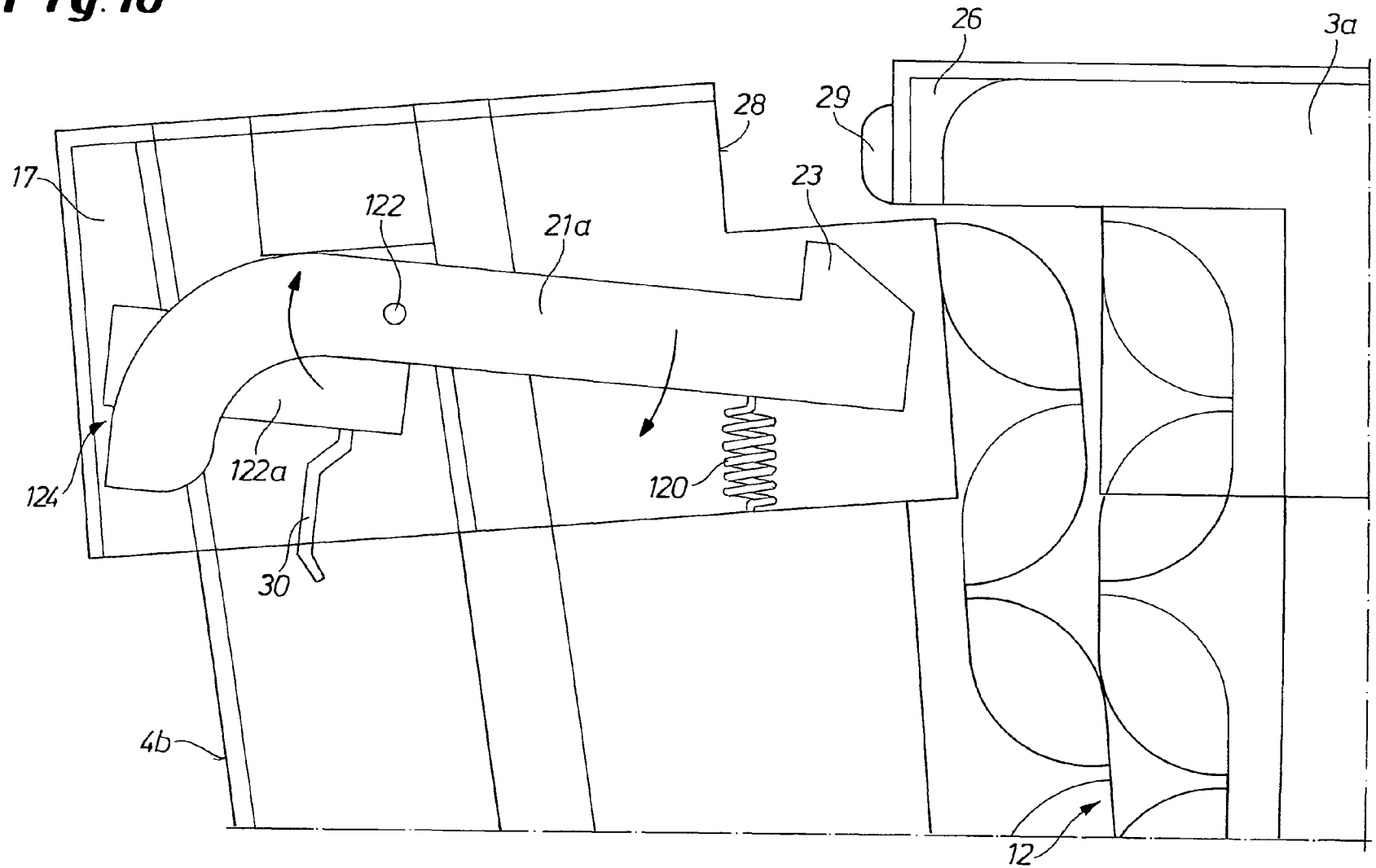
FIG. 10 shows the end wall from FIG. 7 in a schematic partial side view when the box is opened by pivoting the end wall.

To obtain the large unloading opening for the box 1 by pivoting the end wall 4*b*, in the closed position of the end wall (see FIGS. 7 through 9) the molded handle 30 need only be gripped, and the one-hand actuating element 124 pivoted or rotated clockwise about the round-section part of the pivot element 122, against the force of the compression springs 120. As a result of the connection via the force-transmitting profiles 122*a* and 122*b*, the latch heads 23 of the latching levers 21*a* and 21*b* disengage from their latching connection in the skirt 17, i.e. in the upper edge of the box, and the projections 29 are also released from the oppositely situated cutouts 28 (see FIG. 4), at the same time opening the toothed engagement 12, as illustrated in FIG. 10.

Figure 11:
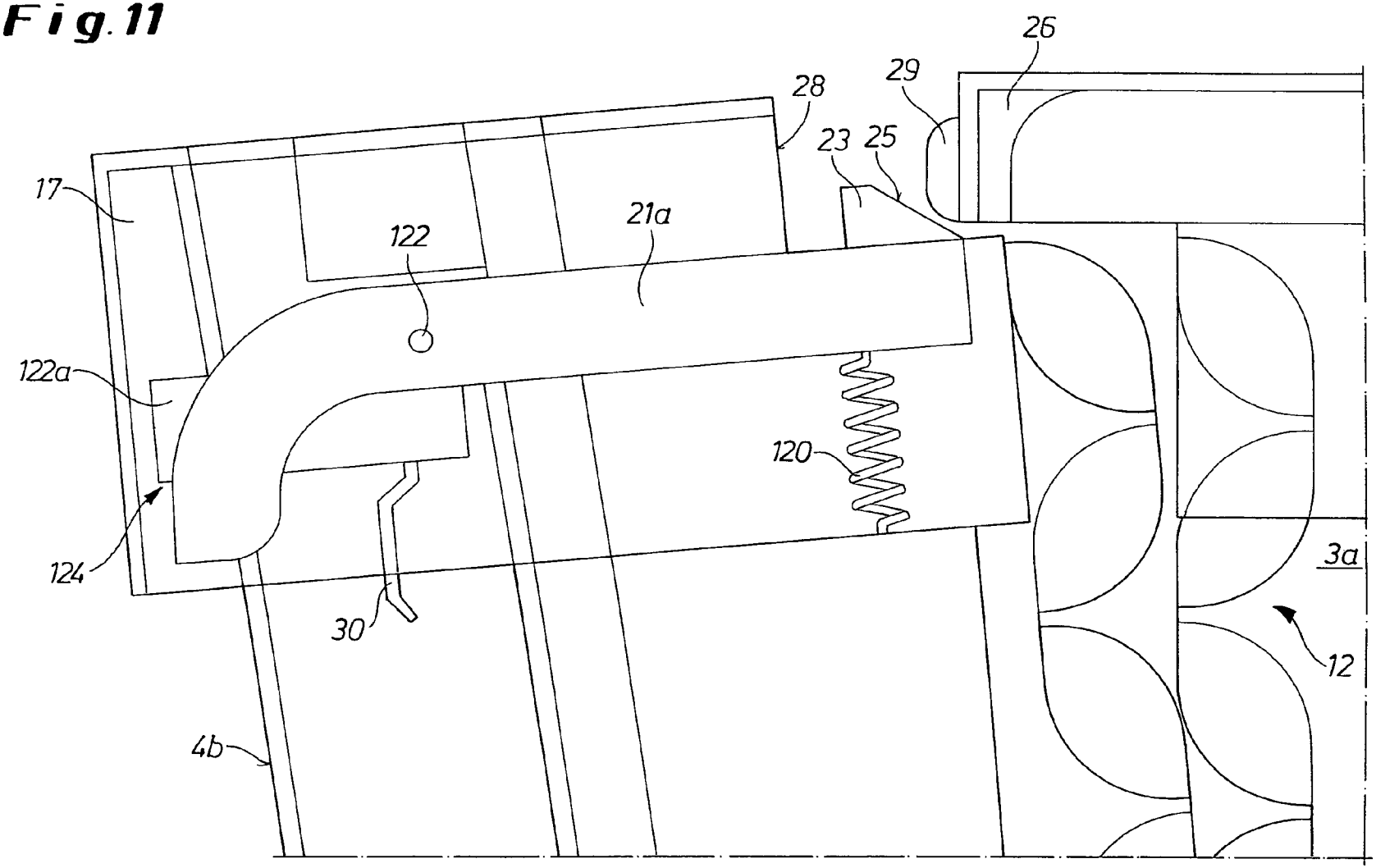
FIG. 11 shows the end wall from FIG. 7 or FIG. 10 in a schematic partial side view when the box is closed by pivoting the end wall.

To close the unloading opening of the box 1, the one-hand actuating element 124 is released so that the latch heads 23 of the latching levers 21*a* are pushed upward out of the movable end wall 4*b* by the force of the compression springs 120. As soon as the projecting ends 26 of the side walls 3*a* and 3*b* reach the actuation face 25 of the latch heads 23 as the result of continued pressing or moving of the end wall 4*b* against the side walls 3*a* and 3*b* of the box 1, as shown in FIG. 11 shortly before contact is made, the latching levers 21*a* and 21*b* move downward in the clockwise direction, and the projecting ends 26 slide over the actuation faces 25 and guide the projections 29 into a form- and pressure-fit connection in the oppositely situated cutouts 28. As soon as the projecting ends 26 have passed the latch heads 23, the latching levers 21*a* and 21*b* automatically lift as the result of impingement by the relaxing compression springs 120 and snap into the latched position in the cavity of the projecting ends 26. The crescent-shaped toothed engagement 12 is then closed as well.

The invention claimed is:

1. A stackable transport and order-picking box, the box comprising:

a floor;

a pair of upright side walls projecting upward from side edges of the floor;

a pair of upright end walls projecting upward from end edges of the side walls between the side walls;

means pivoting one of the end walls at a lower edge thereof for movement between an upright closed position closing a respective end of the box and an open position forming a wide opening at the respective end, the one end wall and one side wall being formed with downwardly projecting skirts defining a downwardly open recess; and a latch at a side edge of the one end wall having a latch element in the recess in the closed position and operable from outside the one end wall for pivoting in a vertical plane between a latched position engaging a respective one of the side walls and holding the one end wall in the closed position and an unlatched position free of the one side wall and permitting the one end wall to swing into the open position, the skirt of the one end wall being cut away and exposing a front end of the latch element.

2. The box defined in claim 1 wherein there are two such latch elements, one at each side edge of the on end wall, the latch further comprising a common pivot element connected to both of the latch elements.

3. The box defined in claim 2 wherein the pivot element has a central round-section part and a pair of profiled end parts connected to the latch elements.

4. The box defined in claim 3 wherein the pivot element has a handle projecting radially from the central part.

5. The box defined in claim 2 wherein the latch comprising spring means urging the latch elements into the latched positions.

6. The box defined in claim 5 wherein the spring means is elastically deformable spring arms formed unitarily with the latch elements and bearing on the one end wall.

7. The box defined in claim 5 wherein each latch element has a front end projecting downward past the skirt of the one end wall.

8. The box defined in claim 5 wherein each end latch element has a rearwardly directed angled actuation face engageable with the respective side wall on pivoting of the one end wall into the closed position for pushing the respective rear end downward against the spring means.

9. The box defined in claim 2 wherein the one end wall is formed at each of its side edges with a cutout open toward the respective side wall and the side walls are formed with respective projections engaging in the cutouts in the closed position of the one end wall.

10. The box defined in claim 2, further comprising complementary formations on the side edges of the one end wall and on confronting end edges of the side walls that interengage in the closed position of the one end wall.

11. The box defined in claim 10 wherein the complementary formation are zipper-like teeth.

12. The box defined in claim 2 wherein the end wall is formed at the respective side edges with inwardly projecting side ridges extending in the closed position upward from the floor and shaped to interfit with the ridges of another such box when nested together.

13. The box defined in claim 12 wherein the side ridges are each formed with an inwardly open recess and all the side ridges taper upward in the closed position.

14. The box defined in claim 13 wherein an outer face of the end wall is formed with grooves complementary to the side ridges.

15. The box defined in claim 1 wherein the one end wall is pivoted about an axis generally coplanar with the floor.

* * * * *